US007557522B2

(12) United States Patent
Ku et al.

(10) Patent No.: US 7,557,522 B2
(45) Date of Patent: Jul. 7, 2009

(54) PREHEAT CONTROL DEVICE FOR MODULATING VOLTAGE OF GAS-DISCHARGE LAMP

(75) Inventors: Chung-Ping Ku, Hsinchu County (TW); Ching-Ran Lee, Kinmen County (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 11/680,887

(22) Filed: Mar. 1, 2007

(65) Prior Publication Data

US 2008/0136354 A1 Jun. 12, 2008

(30) Foreign Application Priority Data

Dec. 12, 2006 (TW) ..... 95146518 A

(51) Int. Cl.
*H05B 41/36* (2006.01)

(52) U.S. Cl. ..... 315/307; 315/291; 315/360

(58) Field of Classification Search ..... 315/307, 315/119, 246, 247, 185 R, 186, 189, 193, 315/200 R, 209 R, 211, 213, 214, 215, 219, 315/291, 326, 360, 362

See application file for complete search history.

(56) References Cited

U.S. PATENT DOCUMENTS

| | | | | |
|---|---|---|---|---|
| 5,449,973 | A * | 9/1995 | Yamashita et al. | 315/82 |
| 5,546,300 | A * | 8/1996 | Lee et al. | 363/132 |
| 5,982,106 | A * | 11/1999 | Bobel | 315/209 R |
| 6,421,257 | B2 * | 7/2002 | MacKay et al. | 363/41 |
| 6,531,831 | B2 | 3/2003 | Chou et al. | |
| 7,332,876 | B2 * | 2/2008 | Ichikawa | 315/291 |
| 2005/0156534 | A1 * | 7/2005 | Oh | 315/247 |

* cited by examiner

*Primary Examiner*—Douglas W Owens
*Assistant Examiner*—Jianzi Chen
(74) *Attorney, Agent, or Firm*—WPAT. P.C.; Justin King

(57) ABSTRACT

A preheat control device for modulating the voltage of a gas-discharge lamp is disclosed, which comprises: a pulse-width modulation (PWM) circuit, for controlling the voltage of the gas-discharge lamp while it is operating at a preheat state; a pulse frequency modulation (PFM) circuit, for controlling the frequency of the gas-discharge lamp while it is operating at a steady state so as to stabilize the current flowing through the lamp; and a timing unit, for determining a preheat period of the gas-discharge lamp.

13 Claims, 11 Drawing Sheets

PREHEAT CONTROL DEVICE FOR MODULATING VOLTAGE OF GAS-DISCHARGE LAMP

BACKGROUND OF THE INVENTION

1. Field of the Invention

The present invention generally relates to a preheat control device for modulating the voltage of a gas-discharge lamp and, more particularly, to a preheat control device using pulse-width modulation (PWM) for controlling the voltage of the gas-discharge lamp while it is operating at a preheat state so as to effectively reduce the voltage of the gas-discharge lamp and avoid the glow current while maintaining the preheat current and using pulse frequency modulation (PFM) for controlling the frequency of the gas-discharge lamp while it is operating at a steady state so as to stabilize the current flowing through the lamp. The method of the present invention can be implemented using an analog integrated circuit (IC) or a digital controller without modifying the currently used half-bridge driver and resonant tank network.

2. Description of the Prior Art

The currently used electronic ballasts use half-bridge drivers with half-bridge configurations. In order to be compatible with the design of integrated circuits (ICs), the half-bridge configurations are implemented using class-D design, which exhibits standard half-bridge characteristics and system grounding. Therefore, the class-D design is advantageous in that only one DC-link capacitor is required at the input terminal so as to effectively reduce the manufacturing cost of the electronic ballasts. Please refer to FIG. 1, which is a diagram showing the voltage and the current of a conventional electronic ballast while it is operating at a preheat state, a firing state and a steady state. The conventional electronic ballasts are controlled by PFM during the preheat, firing and steady states. In FIG. 1, when the electronic ballasts using class-D design is at a preheat state, the lamp voltage $V_{LAMP}$ is half of the DC-link voltage because the load is empty-loaded. The filament current $I_F$ generates a glow current at the firing state. If the lamp is frequently turned on and off, the lifetime of the lamp will be shortened. Therefore, there is need in providing a method for overcome the problems due to the lamp voltage during the preheat state.

Generally, there are two solutions for the above-mentioned issue: one is the use of the standard half-bridge configuration and the other is the use of an additional external switch to set the lamp voltage to be zero. However, these two solutions bring forth some drawbacks. For example, the DC-link capacitor is increased for the former and the cost is higher for the latter because of the additional circuitry and the external switch. These drawbacks weaken the marketing competitiveness of the conventional electronic ballasts. Therefore, the currently used configuration can be used and modified to overcome the foregoing problems with shortened time-to-market.

SUMMARY OF THE INVENTION

It is a primary object of the present invention to provide a preheat control device for modulating the voltage of a gas-discharge lamp using pulse-width modulation (PWM) for controlling the voltage of the gas-discharge lamp $V_{LAMP}$ while it is operating at a preheat state so as to effectively reduce the voltage of the gas-discharge lamp and avoid the glow current while maintaining the preheat current and using pulse frequency modulation (PFM) for controlling the frequency of the gas-discharge lamp while it is operating at a steady state so as to stabilize the current flowing through the lamp. The method of the present invention can be implemented using an analog integrated circuit (IC) or a digital controller without modifying the currently used half-bridge driver and resonant tank network.

In order to achieve the foregoing object, the present invention provides a preheat control device for modulating the voltage of a gas-discharge lamp, comprising: a pulse-width modulation (PWM) circuit, for controlling the voltage of the gas-discharge lamp while it is operating at a preheat state; a pulse frequency modulation (PFM) circuit, for controlling the frequency of the gas-discharge lamp while it is operating at a steady state so as to stabilize the current flowing through the lamp; and a timing unit, for determining a preheat period of the gas-discharge lamp.

BRIEF DESCRIPTION OF THE DRAWINGS

The objects, spirits and advantages of the preferred embodiment of the present invention will be readily understood by the accompanying drawings and detailed descriptions, wherein.

DETAILED DESCRIPTION OF THE PREFERRED EMBODIMENT

The present invention can be exemplified by the preferred embodiment as described hereinafter. The present invention discloses a preheat control device for modulating the voltage of a gas-discharge so as to effectively reduce the voltage of the gas-discharge lamp and maintain the preheat current.

Figure 2:
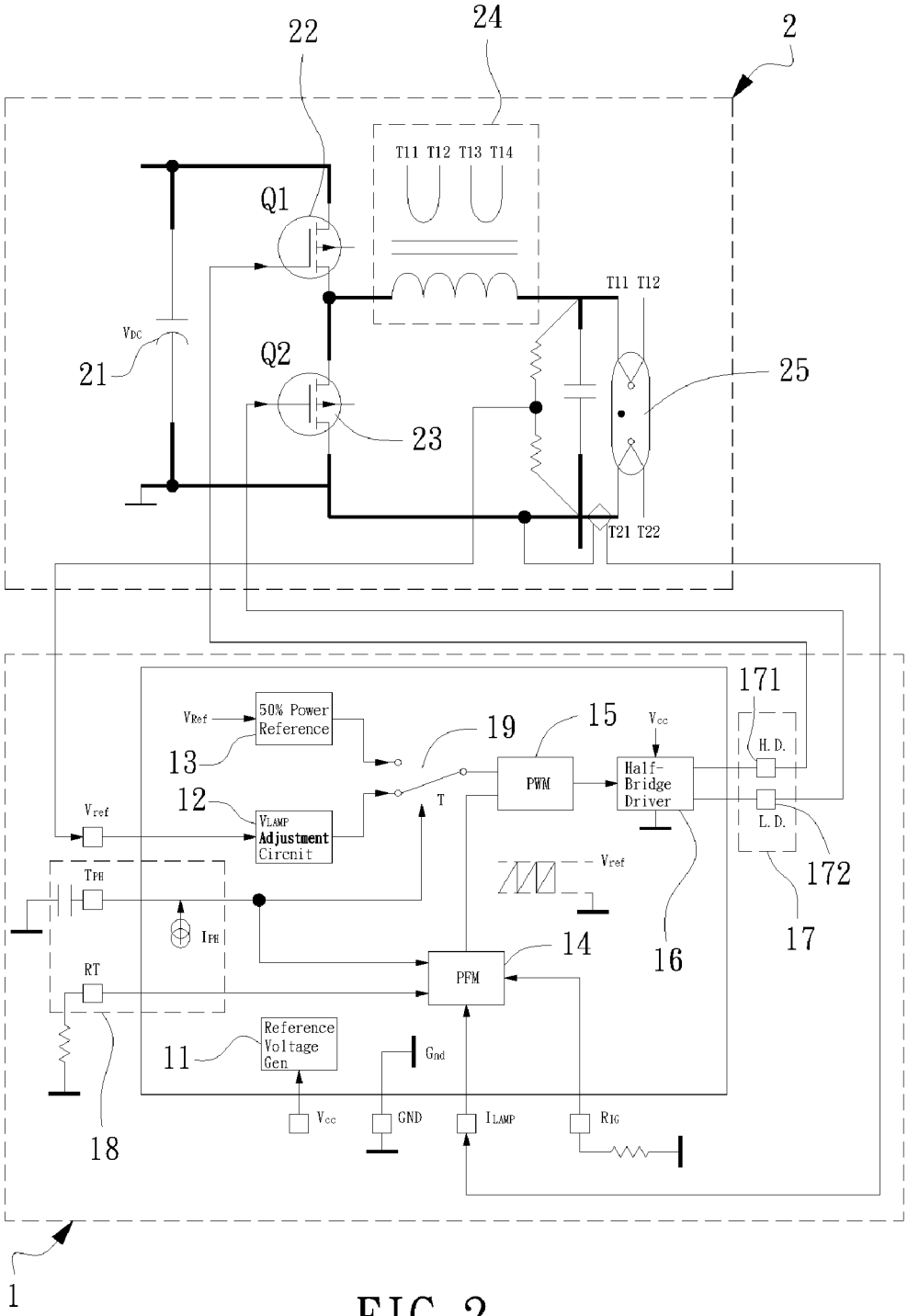
FIG. 2 is a circuit diagram showing a gas-discharge lamp module and an electronic ballast according to the present invention.
Figure 3:
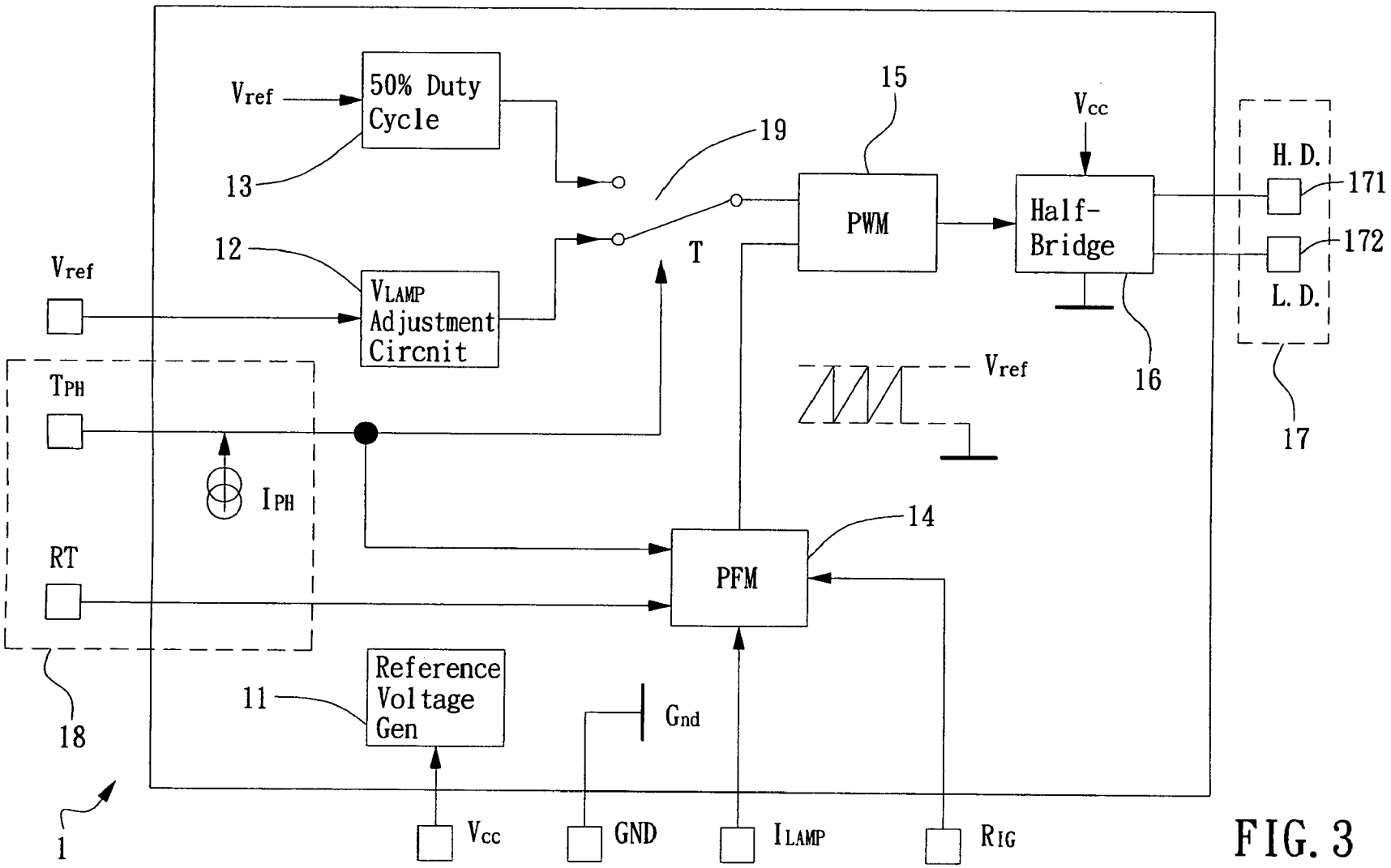
FIG. 3 is a circuit diagram showing an electronic ballast according to the present invention.

Please refer to FIG. 2, which is a circuit diagram showing a gas-discharge lamp module and an electronic ballast, and FIG. 3, which is a circuit diagram showing an electronic ballast according to the present invention. The lamp module 2 has a conventional configuration, comprising a DC-link capacitor 21, a first transistor 22, a second transistor 23, a transformer 24 and a lamp 25. The electronic ballast 1 comprises a reference voltage $V_{ref}$ generator 11, a lamp voltage adjustment circuit 12, a 50% duty cycle reference 13, a PFM circuit 14, a PWM circuit 15, a half-bridge driver 16, a half-bridge transistor driver 17 (comprising a high-side driver 171 and a low-side driver 172), a charging circuit 18 (comprising a current source $I_{PH}$, a resistor $R_T$ and a capacitor $T_{PH}$), a first active switch 19 and a timing unit implemented using an external circuit.

Figure 4:
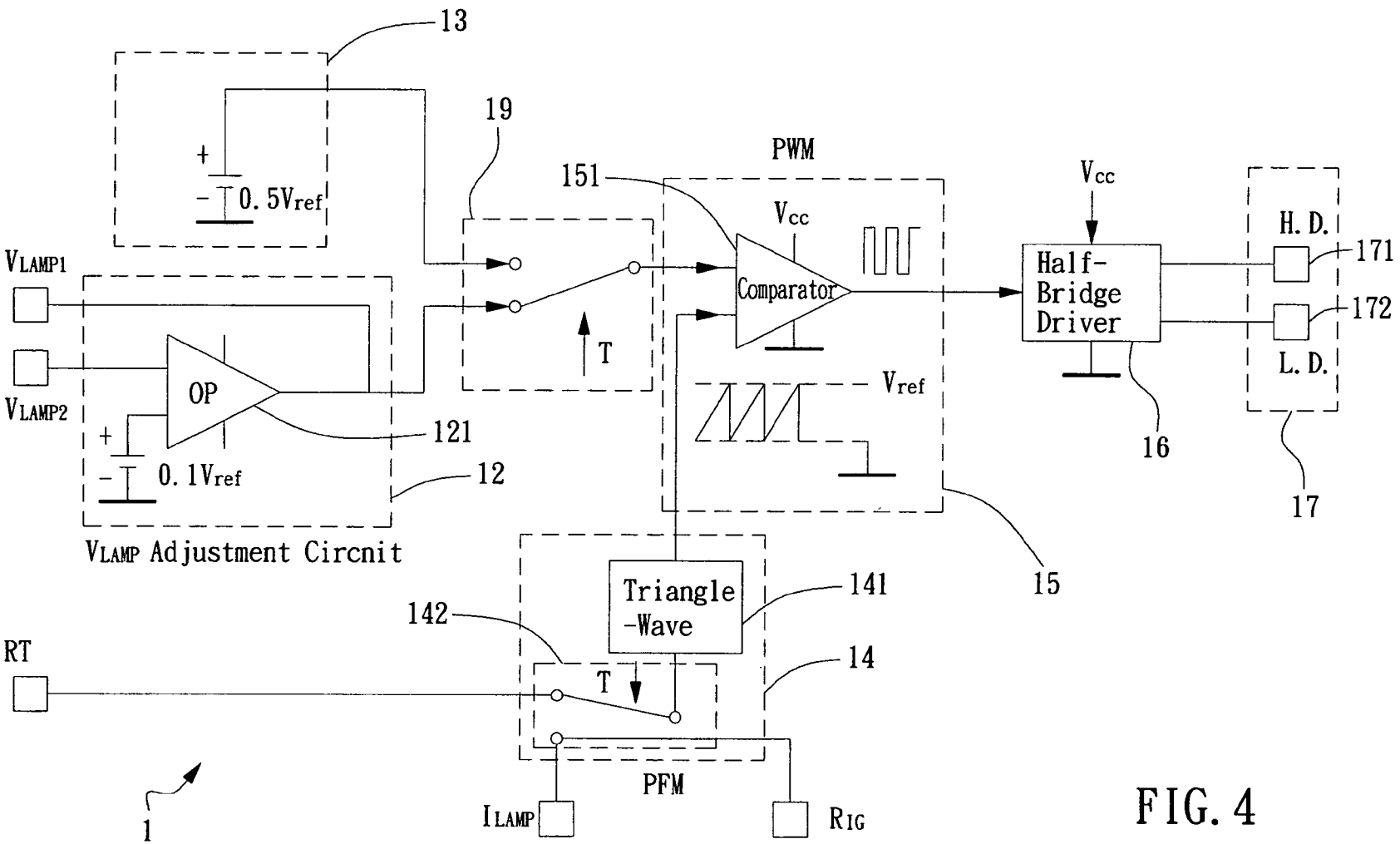
FIG. 4 is a detailed circuit diagram of the electronic ballast in FIG. 3.

Please refer to FIG. 4, which is a detailed circuit diagram of the electronic ballast in FIG. 3. The lamp voltage adjustment circuit 12 comprises an operational amplifier 121. A 10% reference voltage is input into one terminal of the operational amplifier 121 and a second lamp voltage sampling value $V_{LAMP2}$ is input into the other terminal. The PFM circuit 14 comprises a triangle-wave generator 141 and a second active switch 142. The PWM circuit 15 comprises a comparator 151. Moreover, the timing unit can be formed by the charging circuit 18.

Figure 5:
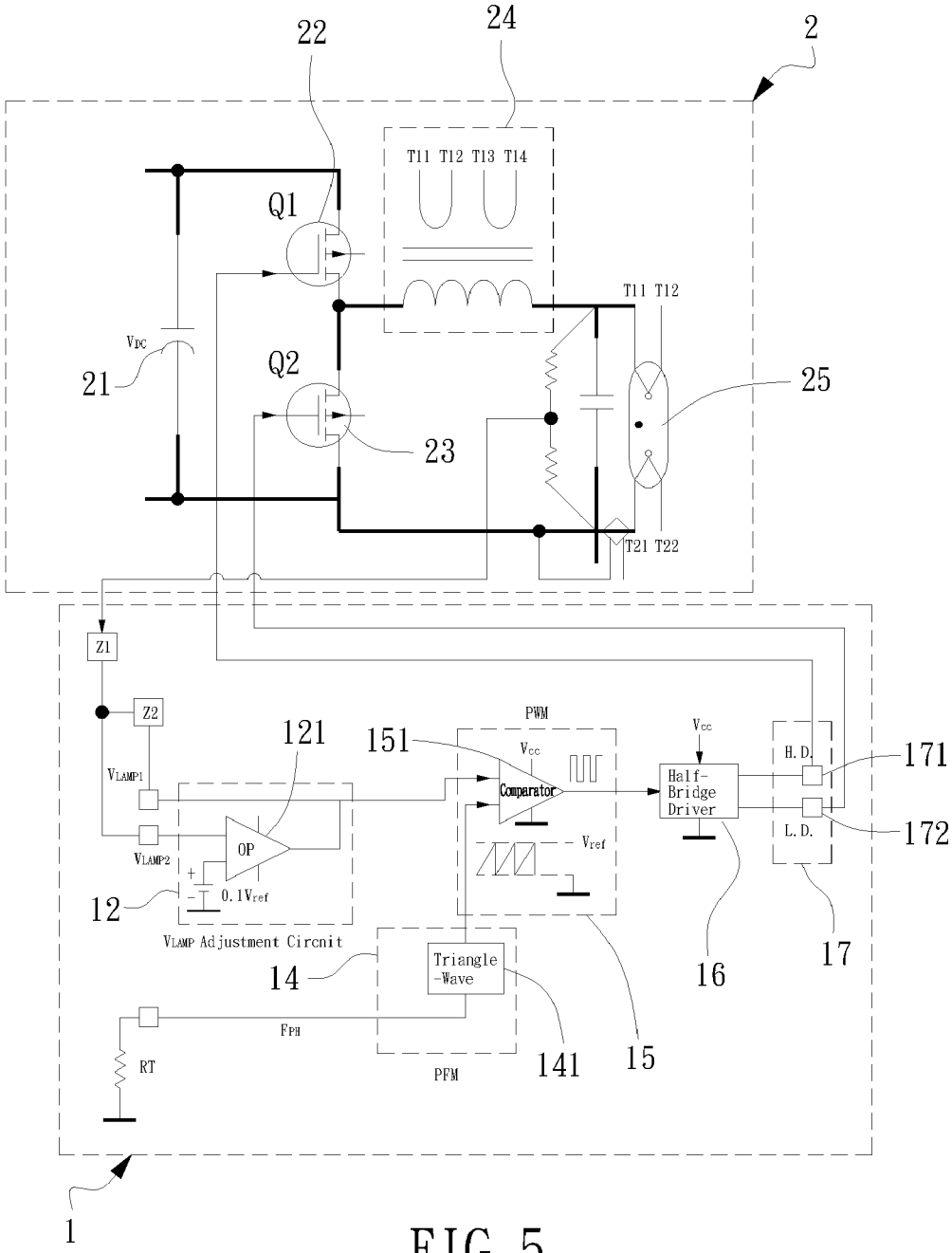
FIG. 5 is a circuit diagram showing an electronic ballast operating at the preheat state according to the present invention.

Please refer to FIG. 5, which is a circuit diagram showing an electronic ballast operating at the preheat state according to the present invention. The electronic ballast is controlled by PWM and compensated by compensation circuits Z1 and Z2. The ignition procedure includes start-up, preheat and scan firing. The present invention emphasizes the start-up and preheat periods. The circuit diagram in FIG. 5 operates in a buck mode, in which the output voltage is larger than the input voltage. By using equation (1), a duty cycle D can be calculated. In the present embodiment, the duty cycle is 10% so that the reference voltage $V_{ref}$ (originally a triangle-wave) is modified to be a square-wave. The output voltage is the lamp voltage $V_{LAMP}$.

$$V_{LAMP}=V_{DC}\cdot D \tag{1}$$

Figure 6:
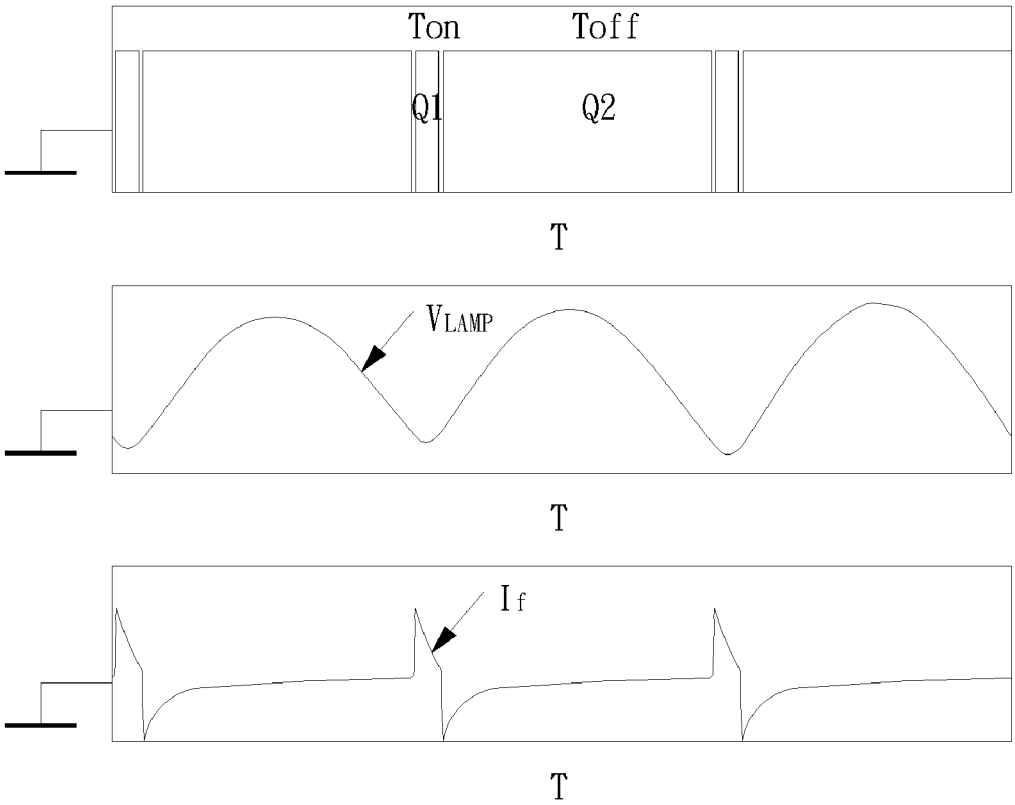
FIG. 6 shows waveforms modulated using PWM according to the present invention.

Please refer to FIG. 6, which shows waveforms modulated using PWM according to the present invention. The two transistor switches 22 and 23 in FIG. 5 have the same operation cycles, but their duty cycles are asymmetrically complementary, as shown in FIG. 6. The modulation process is referred to as PWM performed by the PWM circuit 15. The output voltage comprises AC component generated by the resonant network (L-C) and DC component generated by the PWM circuit 15. An open-loop voltage value can be calculated using equation (1). Close-loop control is achieved by sampling the output voltage and using the lamp voltage adjustment circuit 12 comprising the operational amplifier 121 so as to maintain the output voltage. The output voltage can be expressed as equation (2):

$$v_c = 1/2\cdot V_{ref}\cdot G_V\cdot v_{err} \tag{2}$$

wherein $$v_{err} = (1/2\cdot V_{ref} - v_{LAMP}) \tag{3}$$

$$G_V = 1 + \frac{Z_2}{Z_1} \tag{4}$$

Figure 11:
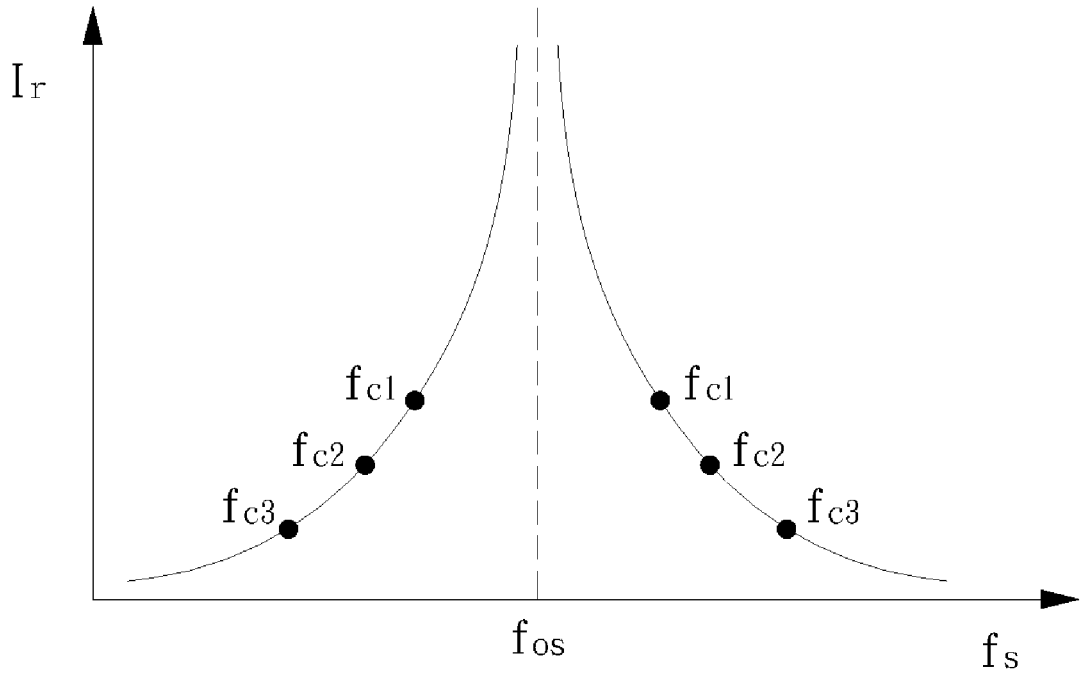
FIG. 11 is a state diagram showing PFM at a fixed frequency for an electronic ballast operating at the preheat state according to the present invention.

Please also refer to FIG. 11, which is a state diagram showing PFM at a fixed frequency for an electronic ballast operating at the preheat state according to the present invention. During preheat, PFM is performed at a fixed frequency $f_{PH}$ larger than the firing frequency $f_{os}$. $f_{PH}$ is determined by the resistor $R_T$.

Figure 7:
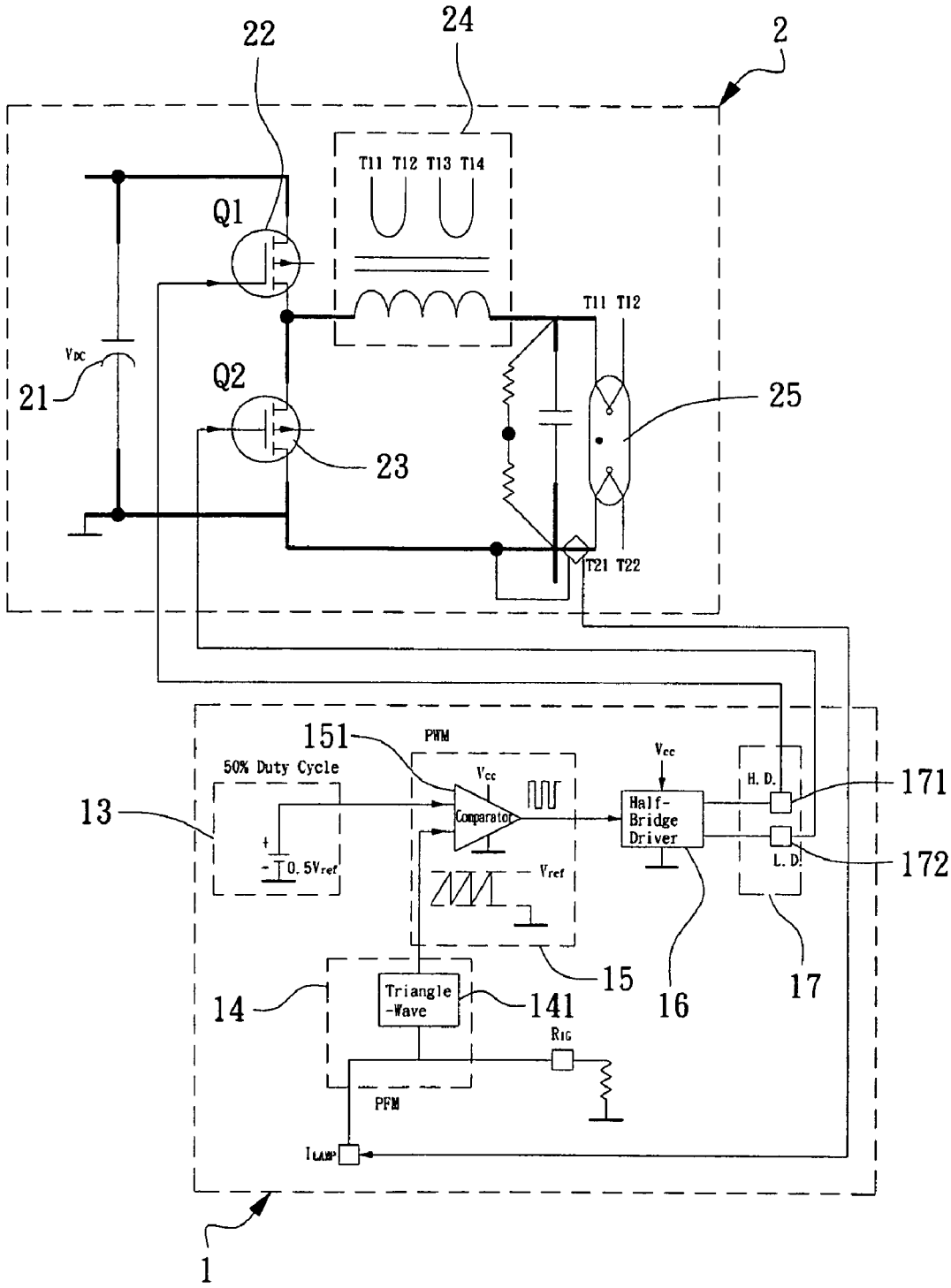
FIG. 7 is a circuit diagram showing an electronic ballast operating at the steady state according to the present invention.
Figure 8:
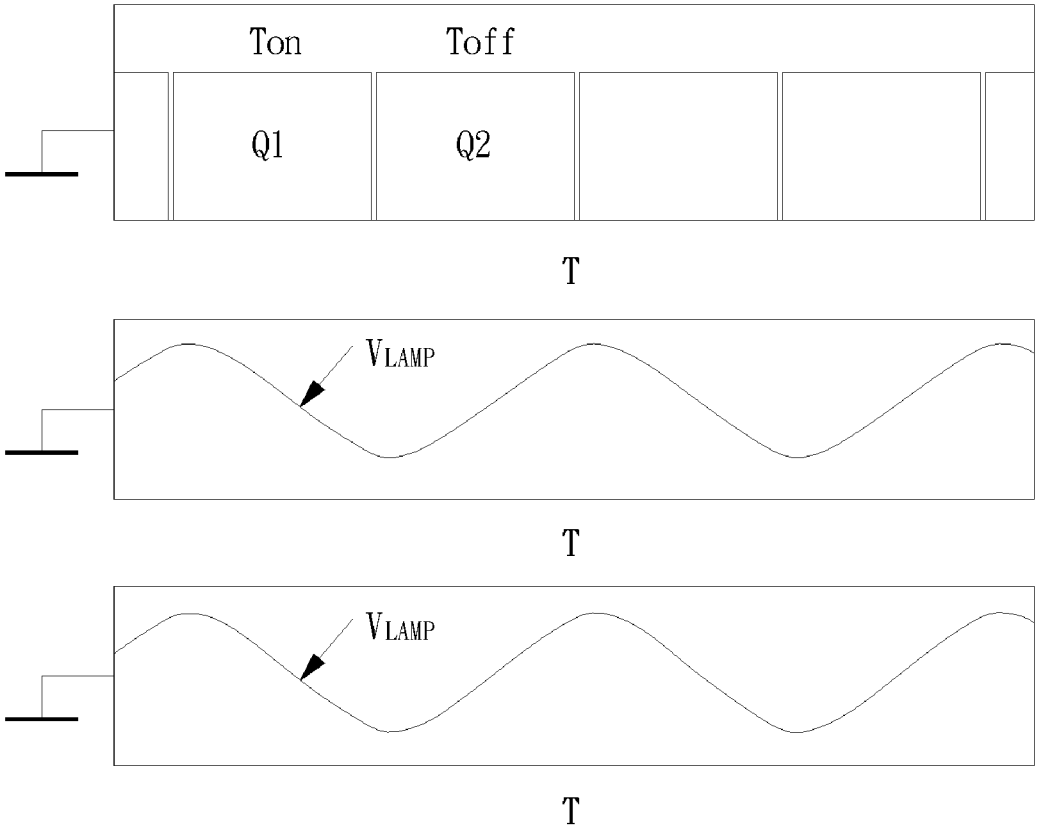
FIG. 8 shows waveforms modulated using PFM according to the present invention.

Referring to FIG. 7, which is a circuit diagram showing an electronic ballast operating at the steady state according to the present invention, the circuit diagram is driven by the half-bridge driver and controlled by PFM when the preheat state ends. The duty cycle of the lamp voltage is 50% reference 13. PFM is determined by a discharge resistor $R_{IG}$, which discharges the capacitor in the triangle-wave generator 141 so that the triangle-wave frequency shifts from a high frequency $f_{L3}$ to a resonant frequency $f_{os}$. After the lamp current starts, the operation frequency is determined by the sampled lamp current $I_{LAMP}$ FIG. 8 shows waveforms modulated using PFM according to the present invention. $F_{os}$ can be calculated by using equation (5), wherein $C_s$ is the resonant capacitance and $C_f$ is the resonant inductance.

$$f_{os} = \frac{1}{2\pi\sqrt{L_s\frac{C_sC_f}{C_s+C_f}}} \tag{5}$$

Figure 1:
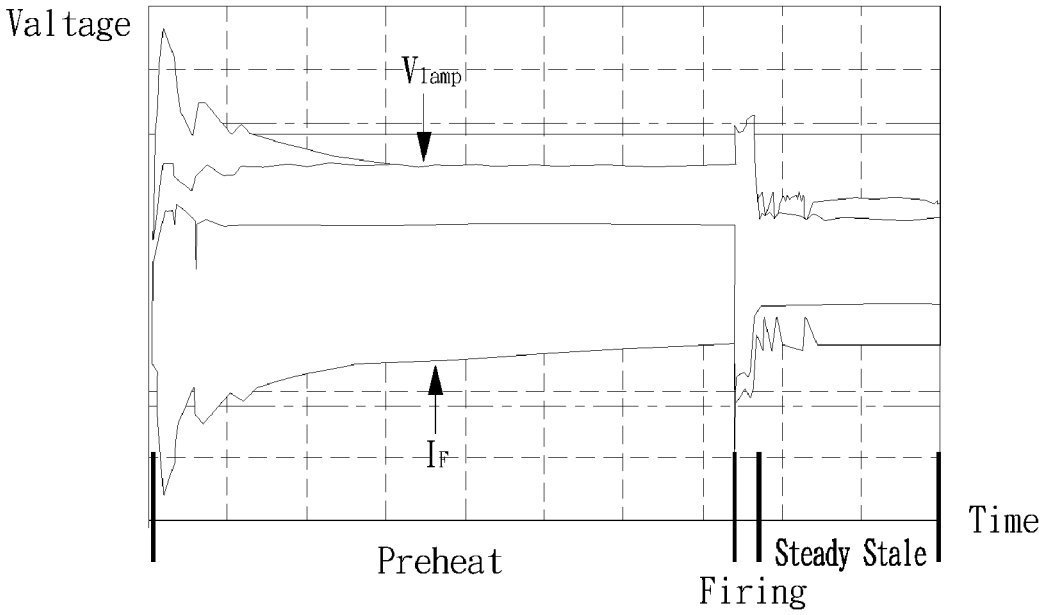
FIG. 1 (Prior Art)
FIG. 1 is a diagram showing the voltage and the current of a conventional electronic ballast while it is operating at a preheat state, a firing state and a steady state.
Figure 9:
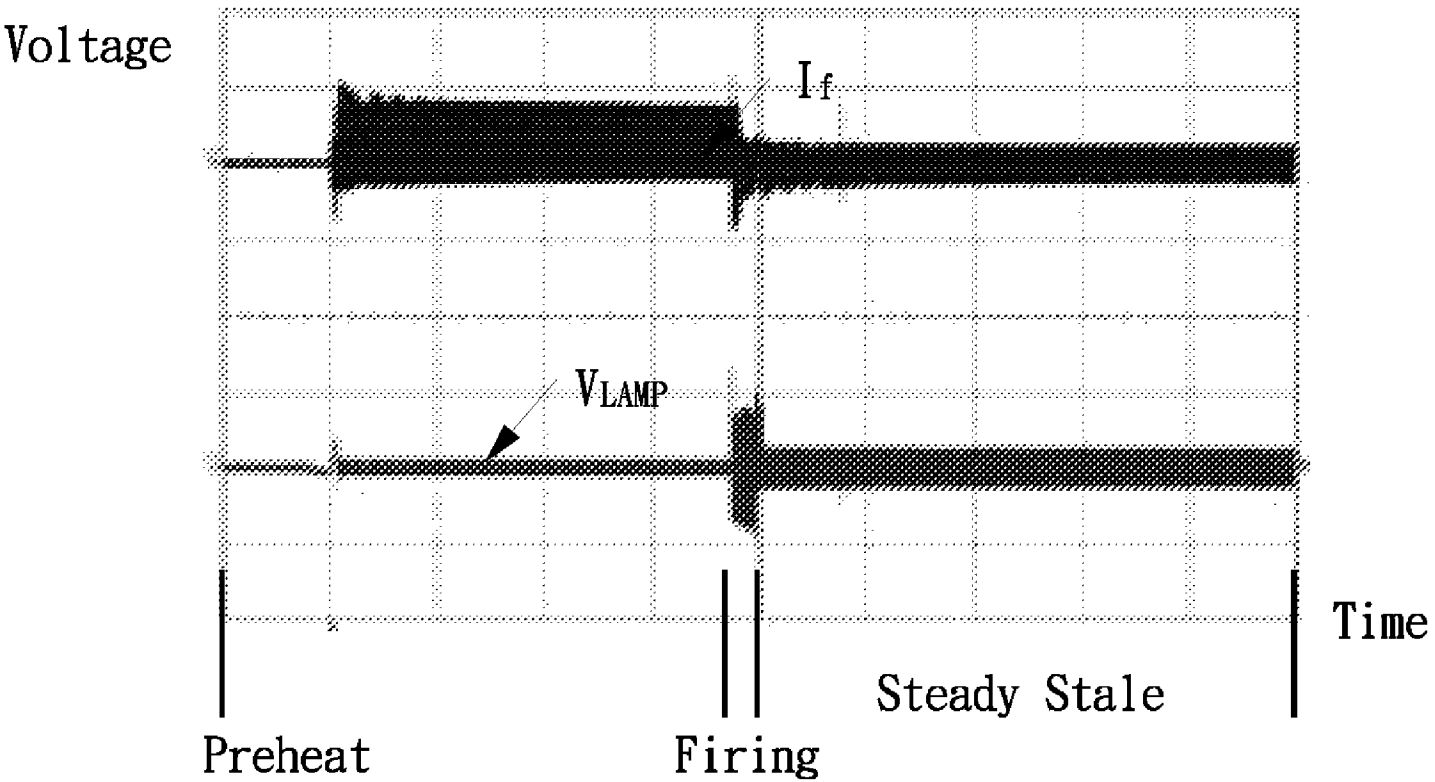
FIG. 9 is a diagram showing the voltage and the current of an electronic ballast while it is operating at a preheat state, a firing state and a steady state according to the present invention.

Please refer to FIG. 9, which is a diagram showing the voltage and the current of an electronic ballast while it is operating at a preheat state, a firing state and a steady state according to the present invention. Therefore, by using PWM-PFM modulation according to the present invention, the lamp voltage $V_{LAMP}$ during preheat is effectively reduced. Compared to FIG. 1, for example, the lamp voltage $V_{LAMP}$ is ½ $V_{DC}$ and the root-mean-square voltage $V_{rms}$ is 200V. However, in FIG. 9, the root-mean-square voltage $V_{rms}$ is 35V. It is obvious that the circuit configuration of the present invention can effectively reduce the lamp voltage during preheat while maintaining the preheat current. Moreover, the circuit configuration of the present invention can be implemented without modifying the currently used class-D design.

Figure 10:
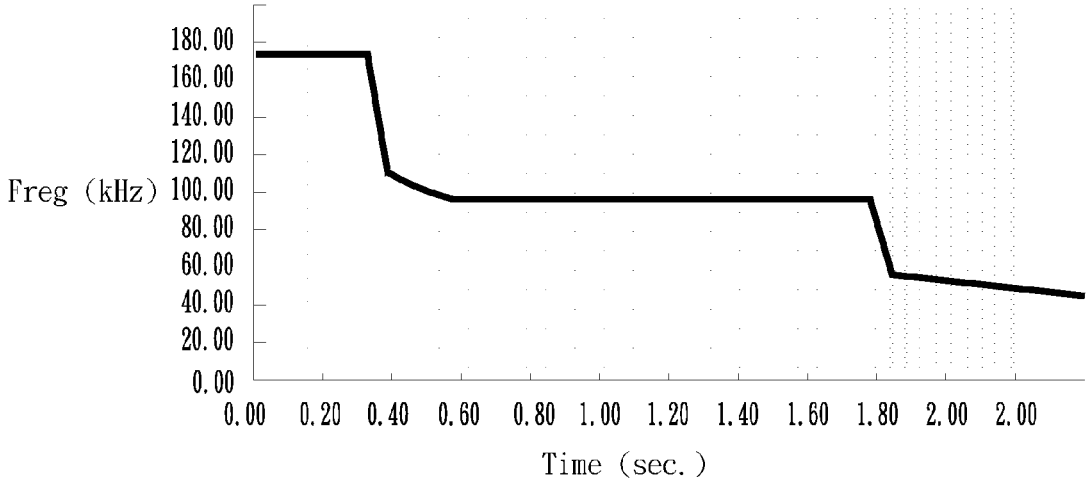
FIG. 10 is a diagram showing the frequency response after being modulated using PFM according to the present invention.

Please refer to FIG. 10, which is a diagram showing the frequency response after being modulated using PFM according to the present invention.

Therefore, from FIG. 2 to FIG. 11, the present invention discloses a preheat control device for modulating the voltage of a gas-discharge lamp, comprising:

a pulse-width modulation (PWM) circuit, for controlling the voltage of the gas-discharge lamp while it is operating at a preheat state, the PWM circuit comprising an operational amplifier compensated by an external circuit for voltage sampling, a comparator for generating a PWM waveform, and a 1/10 reference voltage generator for generating a 1/10 reference voltage ($0.1V_{ref}$);

a pulse frequency modulation (PFM) circuit, for controlling the frequency of the gas-discharge lamp while it is operating at a steady state so as to stabilize the current flowing through the lamp, the PFM circuit comprising a triangle-wave generator with a variable frequency and a peak value equal to the reference voltage ($V_{ref}$), a resonator comprising a capacitor and resistors, and a reference voltage generator for generating a reference voltage, the capacitor being an external element or is built in the triangle-wave generator; and a timing unit, for determining a preheat period of the gas-discharge lamp, further comprising:

two active switches, switching frequency modulation from PWM to 50% duty cycle and being implemented using metal-oxide-semiconductor field-effect transistors;

a charging circuit, comprising a current source $I_{PH}$, a resistor $R_T$ and a capacitor $T_{PH}$, for driving the active switches;

a buck inverter, operating during the preheat state, determining the DC component of the voltage of the gas-discharge lamp during the preheat state, and being determined by the external circuit to operate in a closed loop or an open loop; and a half-bridge driver, operating during the firing state and the steady state.

Furthermore, from FIG. 2 to FIG. 11, the present invention discloses a preheat control device for modulating the voltage of a gas-discharge lamp, using pulse-width modulation (PWM) for controlling the voltage of the gas-discharge lamp while it is operating at a preheat state so as to effectively reduce the voltage of the gas-discharge lamp and avoid the glow current while maintaining the preheat current and using pulse frequency modulation (PFM) for controlling the frequency of the gas-discharge lamp while it is operating at a steady state so as to stabilize the current flowing through the lamp. The method of the present invention can be implemented using an analog integrated circuit (IC) or a digital controller without modifying the currently used half-bridge driver and resonant tank network.

According to the above discussion, it is apparent that the present invention discloses a preheat control device for modulating the voltage of a gas-discharge lamp using pulse-width modulation (PWM) for controlling the voltage of the gas-discharge lamp while it is operating at a preheat state so as to effectively reduce the voltage of the gas-discharge lamp and avoid the glow current while maintaining the preheat current and using pulse frequency modulation (PFM) for controlling the frequency of the gas-discharge lamp while it is operating at a steady state so as to stabilize the current flowing through the lamp. Therefore, the present invention is novel, useful and non-obvious.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A preheat control device for modulating the voltage of a gas-discharge lamp, comprising:

a pulse-width modulation (PWM) circuit, for controlling the voltage of the gas-discharge lamp while it is operating at a preheat state;

a pulse frequency modulation (PFM) circuit, for controlling the frequency of the gas-discharge lamp while it is operating at a steady state so as to stabilize the current flowing through the lamp; and a timing unit, for determining a preheat period of the gas-discharge lamp;

wherein the timing unit comprises:

two active switches; and a charging circuit, comprising a current source, a resistor and a capacitor;

wherein the active switches switch frequency modulation from PWM to 50% duty cycle.

2. The preheat control device as recited in claim 1, wherein the PWM circuit comprises an operational amplifier for voltage sampling, a comparator for generating a PWM waveform, and a 10% reference voltage generator for generating a 10% reference voltage.

3. The preheat control device as recited in claim 2, wherein the operational amplifier is compensated by an external circuit.

4. The preheat control device as recited in claim 1, wherein the PFM circuit comprises a triangle-wave generator, a resonator comprising a capacitor and resistors, and a reference voltage generator for generating a reference voltage.

5. The preheat control device as recited in claim 4, wherein the triangle-wave generator has a variable frequency and a peak voltage equal to the reference voltage.

6. The preheat control device as recited in claim 4, wherein the capacitor is an external element or is built in the triangle-wave generator.

7. The preheat control device as recited in claim 1, wherein the active switches are driven by the charging circuit.

8. The preheat control device as recited in claim 1, wherein the active switches are implemented using metal-oxide-semiconductor field-effect transistors.

9. The preheat control device as recited in claim 1, further comprising:

a buck inverter; and a half bridge driver, for current inversion.

10. The preheat control device as recited in claim 9, wherein the buck inverter operates during the preheat state.

11. The preheat control device as recited in claim 9, wherein the buck inverter determines the DC component of the voltage of the gas-discharge lamp during the preheat state.

12. The preheat control device as recited in claim 9, wherein the buck inverter is determined by the external circuit to operate in a closed loop or an open loop.

13. The preheat control device as recited in claim 9, wherein the half-bridge driver operates during the firing state and the steady state.

* * * * *